US007308810B2

(12) United States Patent
Menta San Miguel

(10) Patent No.: US 7,308,810 B2
(45) Date of Patent: Dec. 18, 2007

(54) ENGAGING MECHANISM FOR LOCKS

(75) Inventor: Fermin Menta San Miguel, Irun (ES)

(73) Assignee: Talleres de Escoriaza, S.A., Guipuzcoa (ES)

( * ) Notice: Subject to any disclaimer, the term of this patent is extended or adjusted under 35 U.S.C. 154(b) by 187 days.

(21) Appl. No.: 11/191,893

(22) Filed: Jul. 28, 2005

(65) Prior Publication Data

US 2006/0021404 A1 Feb. 2, 2006

(30) Foreign Application Priority Data

Aug. 2, 2004 (ES) ..... 200401923

(51) Int. Cl.
*E05B 55/04* (2006.01)

(52) U.S. Cl. ..... 70/472; 70/218; 70/222; 70/189

(58) Field of Classification Search ..... 70/472, 70/218, 222, 223, 188, 189
See application file for complete search history.

(56) References Cited

U.S. PATENT DOCUMENTS 4,429,556 A 2/1984 Kambic ..... 70/149
4,995,248 A 2/1991 Liu ..... 70/107
5,027,629 A 7/1991 Liu ..... 70/277
5,475,996 A 12/1995 Chen ..... 70/279.1
5,640,863 A 6/1997 Frolov ..... 70/283
5,735,151 A 4/1998 Nickeas et al. ..... 70/221
5,813,261 A 9/1998 Boehlow ..... 70/379 R
5,953,942 A 9/1999 Doucet et al. ..... 70/283
5,987,945 A 11/1999 Ruano Aramburu ..... 70/277
5,992,191 A 11/1999 Nickeas et al. ..... 70/218
6,286,347 B1 9/2001 Frolov ..... 70/472
6,363,762 B1 4/2002 Kueng ..... 70/278.3
6,651,468 B2 11/2003 Aramburu et al. ..... 70/222
6,837,081 B2 1/2005 Ruano Aramburu et al. . 70/218
7,073,359 B2 * 7/2006 San Jose Santamarta .. 70/278.7

* cited by examiner

*Primary Examiner*—Suzanne Dino Barrett
(74) *Attorney, Agent, or Firm*—Nields & Lemack

(57) ABSTRACT

Improvements for an engaging mechanism for locks, wherein a spindle (6*b*) of the radial actuator (6) has an articulated connection to the tip of a first elastic arm (13), which elastic arm is radially fixed at its other end in an axis (14) that is mounted with freedom to turn, and that one end of a second elastic arm (15) is radially fixed in this axis (14) with a 90° difference in rotation, the second elastic arm having its other end meshing with the spiral thread of an endless screw (16), which forms the output axis of an electric motor (17) that turns in both directions of rotation and is oriented transversely to said freely rotating axis (14).

4 Claims, 3 Drawing Sheets

ENGAGING MECHANISM FOR LOCKS

CROSS -REFERENCE TO RELATED APPLICATIONS

This application is related to U.S. Pat. No. 6,837,081 (Ser. No. 10/277,600), the disclosure of which is hereby incorporated by reference.

FIELD OF THE INVENTION

The present Addition Patent concerns an engaging mechanism for locks which, in regard to the interior and exterior sides of a lock installed in a door, contains an inner axis (1), an outer axis (2), a static body (3), a set of radial pin (4) and radial counterpin (5), and a radial actuator (6).

PRIOR ART

The status of the invention of the present Addition Certificate is by its very nature the essential content covered by the Patent of Invention P-200102469; which, in its first claim, states that: said inner axis, outer axis and static body form a coaxial assembly in which the outer axis penetrates with rotational fit the cavity of the inner axis, while both inner and outer axes are installed with a rotational fit in the static body; said set of radial pin and radial counterpin is installed with sliding fit between an actuator, which is in contact with the radial pin, and a radial spring, which acts between the radial counterpin and the bottom of a housing of the outer axis, whose radial pin and radial counterpin are dimensioned in combination in such a way that one or the other is exclusively able to span the circumference of the outer diameter of the outer axis and the circumference of the inner diameter of the inner axis; and said radial actuator is comprised of a curved plate and at least one spindle, which curved plate is located in an annular recess defined between said inner axis and said static body, where this curved plate extends in a circumferential arc over the angular sector corresponding to the rotatory working travel of said inner axis in either direction from a central position, and which spindle of the radial actuator is installed with sliding fit in said static body and, if only a single spindle is present, said spindle is at the center of said curved plate and lined up with said radial pin and radial counterpin in said position of rest.

In this embodiment of Patent P-200102469, the lifting of the actuator (disengaged state or door closed) is produced by the thrust produced by the most prominent part of a rotary eccentric lever as it encounters in its rotation the lower end of the spindle of this actuator; however, the lowering of the actuator is due solely to gravity and the assistance of the radial counterspring of the pin/counterpin set, whose specific mission is to position this combination set and, since it is properly adjusted for this mission, the additional force, which it can provide is not great. The lowered position of the actuator (engaged state or door open) is permitted because said rotary eccentric lever now presents its less prominent part at the end of said spindle of the actuator.

In the current arrangement, the gravitational lowering of the actuator may be affected if adjustment tolerances, rough surfaces, irregularities in shape and/or dimension fortuitously combine and prevent the actuator from descending and producing the engagement, so that the door will remain locked when we wish to open it, and this feature must be improved in a precision lock system.

It therefore becomes necessary to seek a solution which guarantees that the actuator, besides being lifted, will also descend whenever it is so required. Given that this system of engagement of Patent P-200102469 is for lock systems and that one typical application purpose is for electromechanical locks, where an electrical excitation is required for its opening and closing, the solution sought should correspond to a simple device with low energy consumption.

SUMMARY OF THE INVENTION

In this state of affairs, the subject of the present Addition Certificate to Patent P-20002469 proposes a solution in which said spindle of the radial actuator has an articulated connection to the tip of a first elastic arm, which is radially fixed at its other end in an axis that is mounted with freedom to turn, and that one end of a second elastic arm is radially fixed in this axis with a 90° difference in rotation, having its other end meshing with the spiral thread of a screw, which forms the output axis of an electric motor that turns in both directions of rotation and is oriented transversely to said freely turning axis. This solution provides the reliability that has been lacking thus far, in that it sufficiently brings about both the lifting and the lowering of the radial actuator by active means of thrusting, since they are applied directly to the spindle of this radial actuator and they are very light and require a very small energy consumption.

In accordance with what is proposed by the present Addition Certificate, the tip of the first elastic arm free from its operational articulation with the spindle, the effective lengths of said first and second elastic arms, the relation between these lengths and the amplitude [of] the operational rotation of the electric motor in each direction are such as to produce at this tip a rotary travel whose component in the vertical direction of the displacement of said spindle is greater than the lifting/lowering operational travel of this spindle in a suitable proportion. This allows the following: at the ends of the lifting and lowering travel movements, if the first elastic arm cannot go as far as it would be able to in the free state (not articulating with the spindle) it is elastically deformed and builds up a certain amount of elastic energy, making sure that said end points of the travel movement will be attained and therefore the functioning will be correct. Furthermore, this arrangement entails the creation of an "elastic memory" which, when the opening or closing operation is initiated and the screw turns in the proper direction, if there is a temporary obstruction, the operation will be carried out when said obstruction disappears by releasing said energy built up by the elastic deformation of the first elastic arm.

According to another feature of the invention, for its engagement with said screw, said second elastic arm has one end bent at 90°, being oriented by a suitable longitudinal deviation with respect to said freely rotating axis and being tangentially attached to the core of this screw. This is a preferred embodiment, but does not limit the essence of the invention.

Again, according to a nonlimiting solution of this invention, the articulated connection between the spindle of the radial actuator and the free tip of the first elastic arm consists of the fact that the spindle has certain recesses into which said tip of the first elastic arm enters.

DESCRIPTION OF THE DRAWINGS

To better understand the nature of the present invention, the enclosed drawings represent certain preferred embodiments, being merely of illustrative and nonlimiting purpose.

Figure 9:
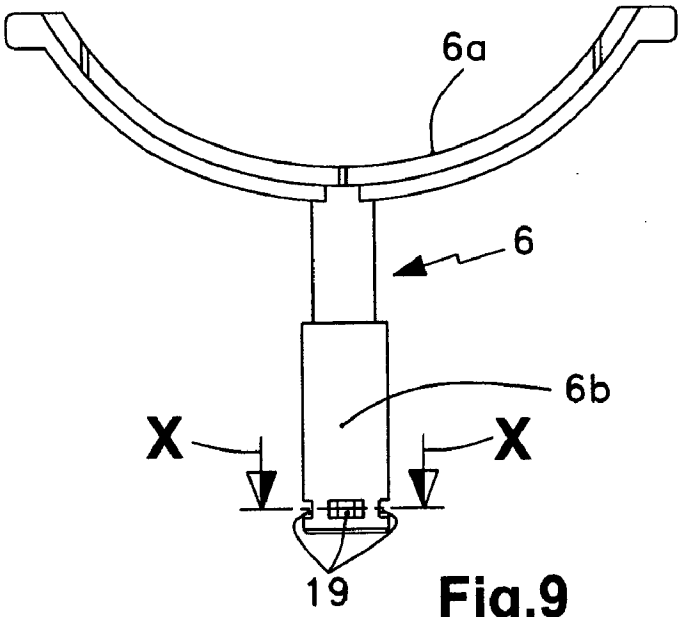
FIG. 9 is an enlarged detail with regard to the spindle (6*b*) of the radial actuator (6).

These FIGS. show the references listed below, which are found in this Addition Certificate, as well as those used for the same purpose and enumerated in the reference Patent P-200102469:

13. First elastic arm
14. Free turning axis
15. Second elastic arm
16. Endless screw
17. Electric motor
18. Bent end of second elastic arm (15)
19. Recesses in the spindle (6*b*)

PRESENTATION OF A PREFERRED EMBODIMENT

With regard to the above-mentioned drawings and references, the enclosed FIGS. illustrate a preferred embodiment of the present Addition Certificate, regarding an improvement applicable to the Patent No. P-200102469, the latter referring to an engaging mechanism for locks which, in regard to the interior and exterior sides of a lock installed in a door, contains an inner axis (1), an outer axis (2), a static body (3), a set of radial pin (4) and radial counterpin (5), and a radial actuator (6), provided with a spindle (6*b*), all of this with the characteristics claimed, in particular, in said reference Patent and which are illustrated in FIGS. 5-8.

Figure 5:
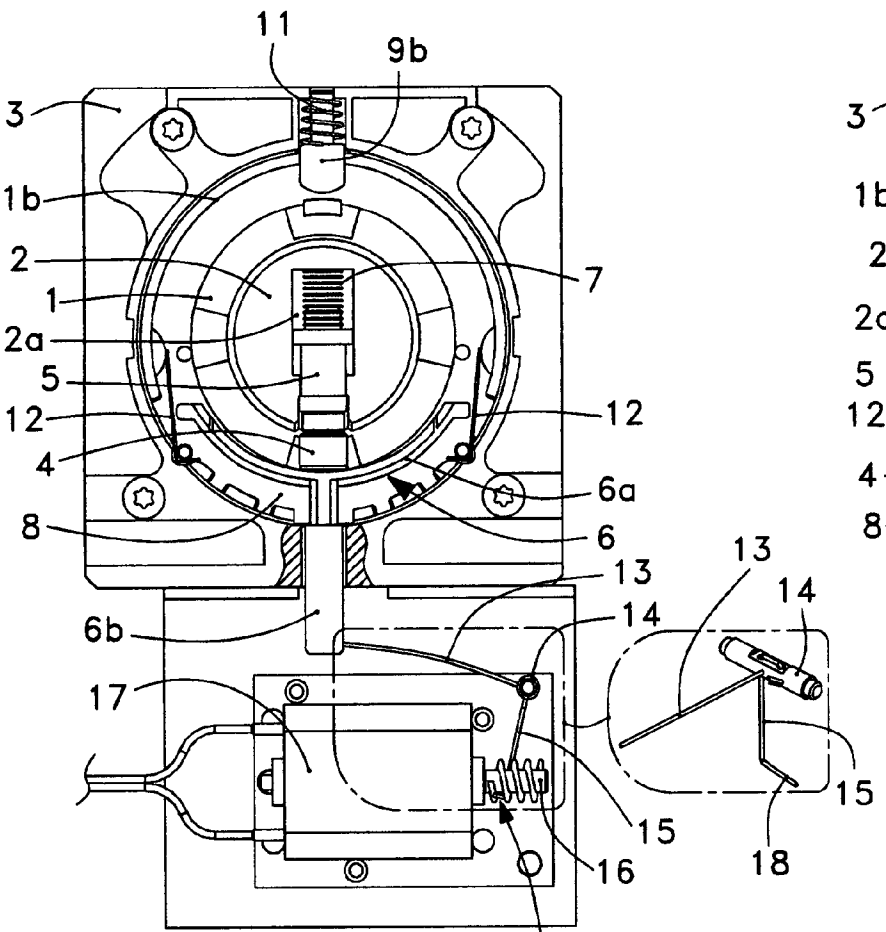
FIG. 5 shows the subassembly of FIGS. 1-4, viewed in the same way as FIG. 2 and operatively applied in accordance with the improvement of this Addition Certificate and applied to an engaging mechanism according to the version that is represented in FIG. 2 of the reference Patent P-200102469, corresponding to the disengaged state or closed door or radial actuator (6) lifted, all of this with the outer axis (2) not being turned.
Figure 8:
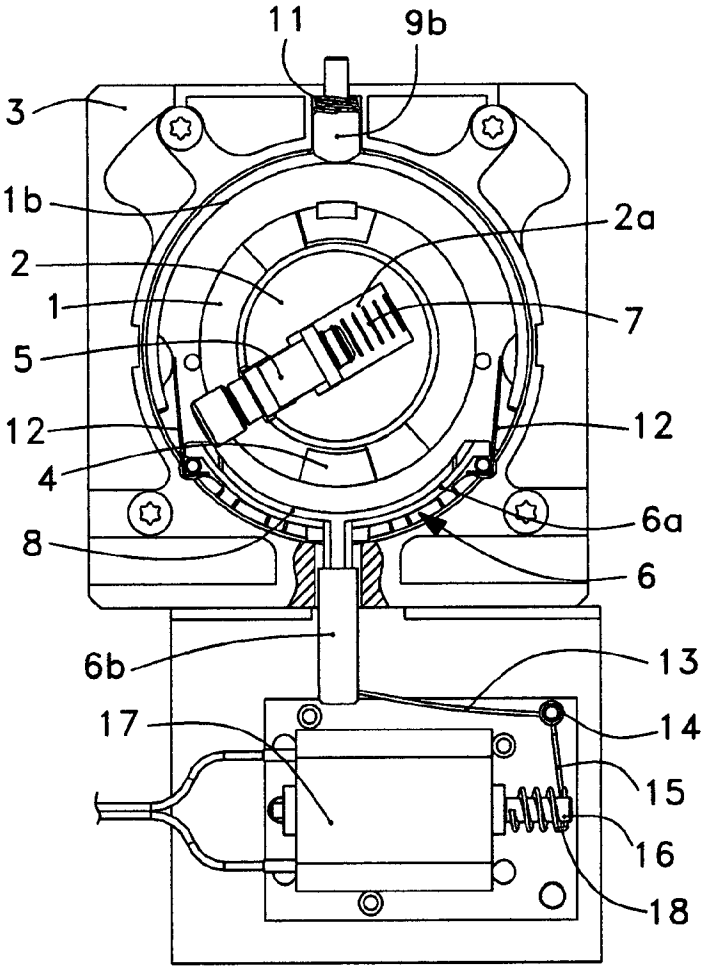
FIGS. 7 and 8 are, respectively, similar to FIGS. 5 and 6, but showing the outer axis (2) rotated, which in the case of FIG. 8 shows that the inner axis (1) is entrained in this rotation.
Figure 7:
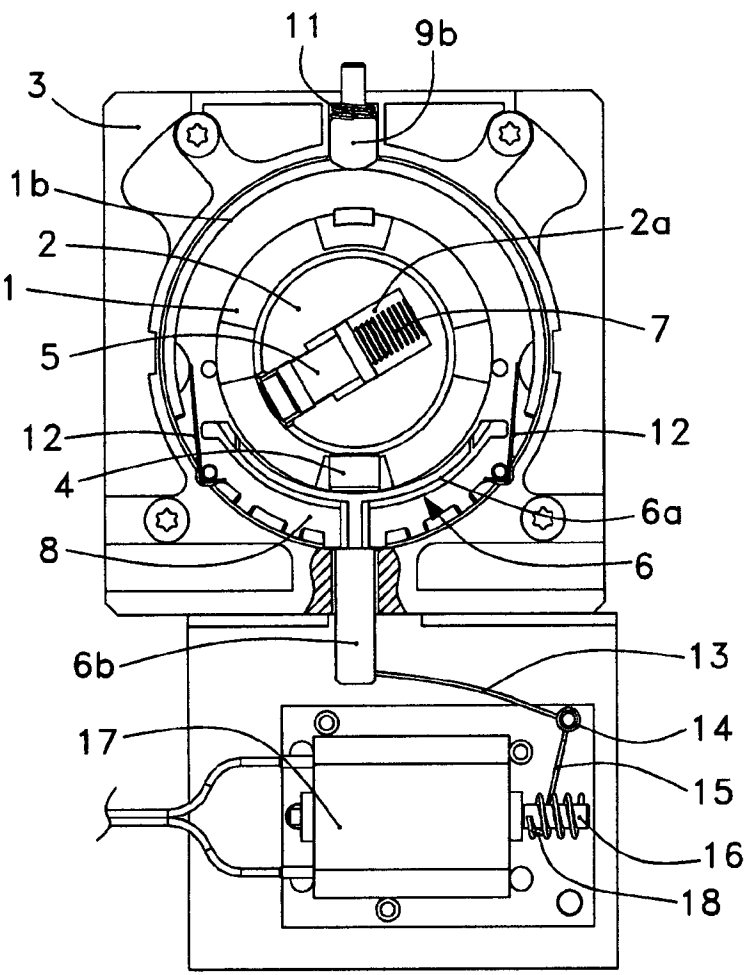

As shown in FIG. 5, the subject of this Addition Certificate consists in that said spindle (6*b*) of the radial actuator (6) has an articulated connection to the tip of a first elastic arm (13), which is radially fixed at its other end in an axis (14) that is mounted with freedom to turn, and that one end of a second elastic arm (15) is radially fixed in this axis (14) with a 90° difference in rotation, having its other end meshing with the spiral thread of an endless screw (16), which forms the output axis of an electric motor (17) that turns in both directions of rotation and is oriented transversely to said freely rotating axis (14).

Figure 6:
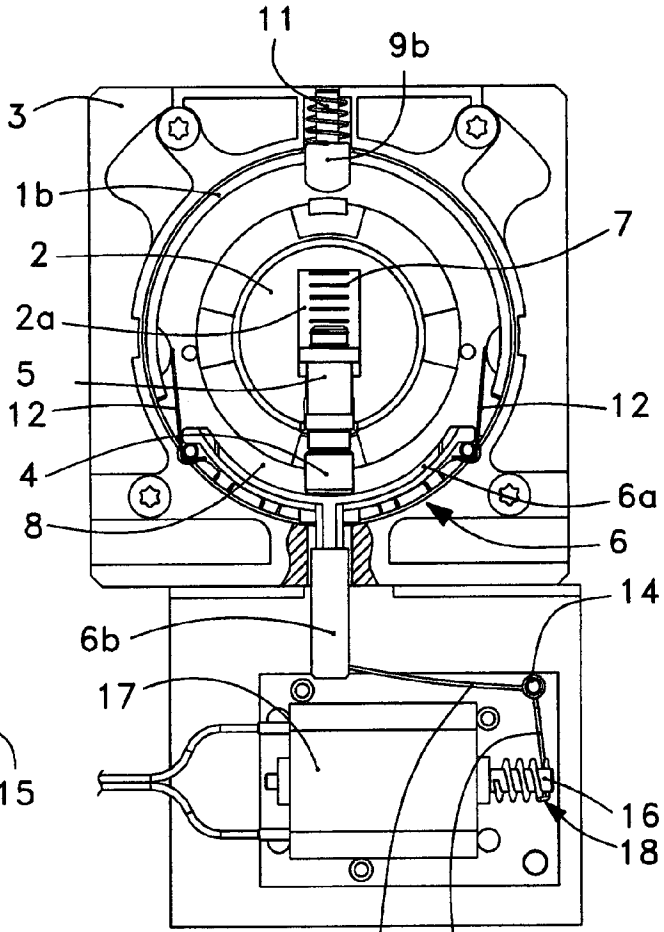
FIG. 6 is similar to FIG. 5, but pertains to the engaged state or open door or radial actuator (6) lowered, and with the outer axis (2) not being turned.

The functioning of this arrangement is well illustrated by comparing FIGS. 5 and 6: when the screw (16) turns in one direction (FIG. 5), the meshing with the second elastic arm (15) makes the latter move to the left, causing the axis (14) to rotate, which, in turn, rotationally entrains in the same direction the first elastic arm (13), whose tip causes the spindle (6*b*) to assume its lifted position, bringing about the disengaged state of the engaging mechanism; however, when the screw (16) rotates in the opposite direction (FIG. 6), the tip of the first elastic arm (13) makes the spindle take up its lowered or engaged position.

As can also be observed in these FIGS. 5 and 6, in the two operating positions mentioned, the first elastic arm (13) is flexed in the sense of trying to go beyond the end of the distance covered, that is, these end operating positions are established with a certain elastic pressure in the same direction of the travel performed to reach them. This is due to the fact that, considering the tip of the first elastic arm (13) free of its operational articulation with the spindle (6*b*), the effective lengths of said first (13) and second (15) elastic arms, the relation between these lengths and the amplitude [of] the operational rotation of the electric motor (17) in each direction are such as to produce at this tip a rotary travel whose component in the vertical direction of the displacement of the spindle (6*b*) is greater than the lifting/lowering operational travel of this spindle (6*b*) in a suitable proportion.

This feature of the invention provides the arrangement with an "elastic memory" which is also useful so that, upon initiating a maneuver, if the radial actuator (6) encounters some type of obstruction preventing its immediate performance, the first elastic arm (13) will build up sufficient elastic energy to accomplish it when said obstacle disappears.

Figure 3:
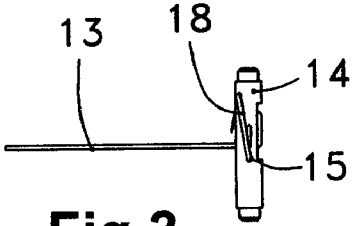
FIG. 3 is the view in lower plane corresponding to FIG. 2.
Figure 2:
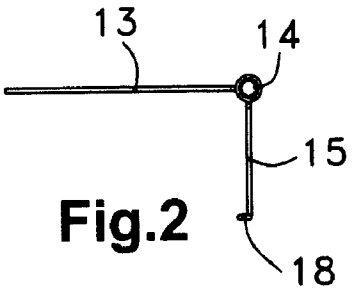
FIG. 2 is an orthogonal projection view that shows the assembly of FIG. 1, viewed from the end that appears in FIG. 5-8.
Figure 4:
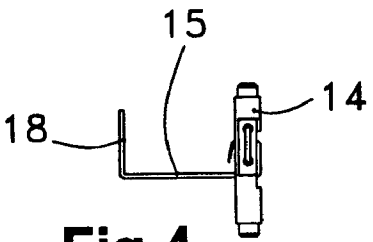
FIG. 4 is the lateral right side view corresponding to FIG. 3.
Figure 1:
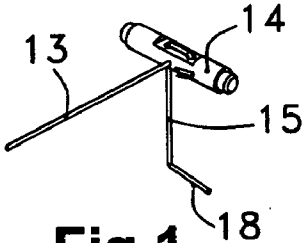
FIG. 1 is a perspective view showing the subassembly formed by the first elastic arm (13), the second elastic arm (15) and the axis (14), viewed from the same side as it appears in the orthogonal projection views corresponding to FIGS. 5-8.

FIGS. 1-4 clearly illustrate the constitution of the subassembly formed by the axis (14) and the first (13) and second (15) elastic arms fixed in it. In this regard, one must point out a preferred embodiment of the invention, consisting in that, for its meshing with said endless screw (16), said second elastic arm (15) has one end (18) bent at 90°, being oriented with a suitable longitudinal deviation with respect to said freely rotating axis (14), and it is attached tangentially to the core of said endless screw (16). FIGS. 2-4 show the bent end (18) without being obstructed by the endless screw (16) in said FIGS. 5 and 6. In particular, FIG. 3 shows said longitudinal deviation of the bent end (18) with respect to the axis (14).

Figure 10:
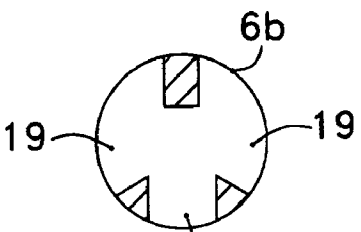
FIG. 10 is an enlargement of cross section X-X, shown in FIG. 9.

On the other hand, FIGS. 9 and 10 illustrate the preferred embodiment regarding the articulated connection between the spindle (6*b*) and the tip of the first elastic arm (13); consisting in that the spindle (6*b*) has certain recesses (19) into which said tip of the first elastic arm (13) enters.

The invention claimed is:

1. An improved engaging mechanism for locks, comprising an interior axis, an exterior axis, a static body, a set of radial pins, a radial catch, a first elastic arm having a tip and another end, a second elastic arm having a first end and a second end, an endless screw having a spiral thread, and a radial actuator comprising at least one spindle, wherein said spindle (6*b*) of the radial actuator has an articulated connection to said tip of said first elastic arm (13), which is radially fixed at said other end in an axis (14) that has freedom to turn, and that said first end of said second elastic arm (15) is radially fixed in said axis (14) with a 90° difference in rotation, having its second end meshing with said spiral thread of said endless screw (16), which forms the output axis of an electric motor (17) that turns in both directions of rotation and is oriented transversely to said freely rotating axis (14).

2. The improved engaging mechanism for locks, in accordance with claim 1, wherein the effective lengths of said first (13) and second (15) elastic arms, the relation between these lengths and the amplitude of the operational turning of the electric motor (17) in each direction are such as to produce at said tip of said first elastic arm (13) a rotary travel whose component in the vertical direction of the displacement of said spindle (6*b*) is greater than the lifting/lowering operational travel of said spindle (6*b*).

3. The improved engaging mechanism for locks, in accordance with claim 1 or 2, wherein in order for said second elastic arm (15) to mesh with said endless screw (16), said second end of said second elastic arm (15) being bent at 90°, being oriented with a longitudinal deviation with respect to said freely rotating axis (14), and said second end (18) is attached tangentially to the core of said endless screw (16).

4. The improved engaging mechanism for locks, in accordance with claim 1 or 2, wherein said spindle (6*b*) comprises recesses (19) into which said tip of the first elastic arm (13) enters, such that an articulated connection between said spindle and said tip of said first electric arm is created.

* * * * *